US010845034B2

(12) United States Patent
Nichols et al.

(10) Patent No.: US 10,845,034 B2
(45) Date of Patent: Nov. 24, 2020

(54) LIGHTING SYSTEM

(71) Applicant: AVID Labs, LLC, Fort Wayne, IN (US)

(72) Inventors: Joel A. Nichols, Columbia City, IN (US); Alexander W. Tollington, Fort Wayne, IN (US)

(73) Assignee: AVID Labs, LLC, Fort Wayne, IN (US)

( * ) Notice: Subject to any disclaimer, the term of this patent is extended or adjusted under 35 U.S.C. 154(b) by 0 days.

(21) Appl. No.: 16/122,216

(22) Filed: Sep. 5, 2018

(65) Prior Publication Data

US 2019/0072260 A1 Mar. 7, 2019

Related U.S. Application Data

(60) Provisional application No. 62/554,126, filed on Sep. 5, 2017.

(51) Int. Cl.

| | |
|---|---|
| ***F21V 15/01*** | (2006.01) |
| ***F21V 21/002*** | (2006.01) |
| ***F21S 4/24*** | (2016.01) |
| ***F21S 4/22*** | (2016.01) |
| ***F21V 7/00*** | (2006.01) |
| *F21Y 115/10* | (2016.01) |
| *F21S 4/28* | (2016.01) |
| *F21Y 107/40* | (2016.01) |
| *F21Y 103/10* | (2016.01) |

(52) U.S. Cl.

CPC ..... *F21V 15/013* (2013.01); *F21S 4/22* (2016.01); *F21S 4/24* (2016.01); *F21V 7/0091* (2013.01); *F21V 21/002* (2013.01); *F21S 4/28* (2016.01); *F21Y 2103/10* (2016.08); *F21Y 2107/40* (2016.08); *F21Y 2115/10* (2016.08)

(58) Field of Classification Search

CPC ..... F21S 4/20; F21S 4/24; F21S 4/28; F21V 15/013; F21V 21/002

See application file for complete search history.

(56) References Cited

U.S. PATENT DOCUMENTS

| | | | | |
|---|---|---|---|---|
| 6,074,074 A * | 6/2000 | Marcus | B29C 45/14655 | 362/240 |
| 6,796,680 B1 * | 9/2004 | Showers | F21V 15/013 | 362/240 |
| 6,874,919 B2 * | 4/2005 | Stokes | A62B 3/00 | 362/146 |
| 7,604,376 B2 * | 10/2009 | Sloan | F21V 21/005 | 362/240 |
| 7,931,386 B2 | 4/2011 | Nall et al. | | |

(Continued)

FOREIGN PATENT DOCUMENTS

| | | |
|---|---|---|
| DE | 20 2009 007 270 U1 | 12/2009 |
| WO | 2013/059298 A1 | 4/2013 |

*Primary Examiner* — Anabel Ton

(74) *Attorney, Agent, or Firm* — Taylor IP, P.C.

(57) ABSTRACT

A lighting system that includes an extrusion having at least one T-shaped slot therein. The T-shaped slot has an opening along a length of the extrusion, with a lighting encasing unit inserted into the T-shaped slot. The lighting encasing unit includes a shaped light conducting encasement having an internal channel along at least a substantial portion of a length of the shaped light conducting encasement and a light emitting tape assembly inserted into the internal channel.

18 Claims, 5 Drawing Sheets

(56) References Cited

U.S. PATENT DOCUMENTS

| | | | | |
|---|---|---|---|---|
| 8,109,652 | B2 * | 2/2012 | Chen | F21V 19/0045 362/249.02 |
| 9,004,715 | B1 * | 4/2015 | Litke | A47B 47/0008 362/218 |
| 10,132,979 | B2 * | 11/2018 | Wang | G02B 6/0011 |
| 2011/0242811 | A1 * | 10/2011 | Cheng | F21V 19/0045 362/249.03 |
| 2018/0031217 | A1 * | 2/2018 | Tuchler | F21S 8/024 |
| 2018/0283659 | A1 * | 10/2018 | Schubert | F21V 7/0016 |

* cited by examiner

LIGHTING SYSTEM

CROSS REFERENCE TO RELATED APPLICATIONS

This is a non-provisional application based upon U.S. provisional patent application Ser. No. 62/554,126, entitled "AN APPARATUS FOR CAPTURING AND SECURING AN LED TAPE LIGHT INTO A T-SLOT EXTRUSION", filed Sep. 5, 2017, which is incorporated herein by reference.

BACKGROUND OF THE INVENTION

1. Field of the Invention

The present invention relates to a lighting system that has a light unit inserted in a T-slot of an extrusion.

2. Description of the Related Art

A Light Emitting Diode (LED) Strip Light (also known as an LED tape, a tape light or ribbon light) is generally a linear flexible circuit board populated by surface mounted devices (SMD) in the form of LEDs and other components that often come with an adhesive backing. Originally, strip lights were used solely in accent lighting, backlighting, task lighting, and decorative lighting applications. With the increased luminous efficacy of higher-power LEDs, strip lights are now used in applications such as high brightness task lighting, and as fluorescent and halogen lighting fixture replacements.

Typical SMD LEDs are rated as having a 120° beam angle, directed perpendicular to the mounting surface. Although 'Side View' or 'Edge Emitter' SMDs exist and are designed such that light is emitted parallel to the adhering surface, the main focus of this discussion will not be directed at these types of LEDs, but they could be used in the invention discussed herein. The beam angle may be optically modified to be other than the typical 120°.

Tape light is widely available and becoming a common commodity product in the LED lighting industry. The product is both cost effective and easy to install. The product is very versatile and can be cut to the correct length with ease and no additional tools. Tape light is available in indoor configurations, weather and water proof versions, color changing versions and comes in variable widths normally between 8 and 15 mm.

Securing tape light is usually achieved using an adhesive backing with a cover that is removed and the product stuck down to the end use item. In certain situations, a mechanical means of securing is required, in these instances the tape light is normally held down using a crimp that straddles the top of the tape. In yet another instance a cover and channel may be used to secure the tape. Some projects require all three.

For installation into a T-Slot extrusion a tape light is stuck into the extrusion slot using the adhesive backing or a fixed circuit board is slid in. In other situations, the tape may be adhesively secured once inserted into the slot and then a cover is snapped into placed over the top of the opening.

What is needed in the art is a way to allow the use of strip lighting to form a light system that can be manufactured in an economic manner, allowing the quick insertion into a extrusion slot.

SUMMARY OF THE INVENTION

Embodiments of the present invention are a lighting system inserted into an extrusion having a slot therein.

The invention in one form is directed to a lighting system that includes an extrusion having at least one T-shaped slot therein. The T-shaped slot has an opening along a length of the extrusion, with a lighting encasing unit inserted into the T-shaped slot. The lighting encasing unit includes a shaped light conducting encasement having an internal channel along at least a substantial portion of a length of the shaped light conducting encasement and a light emitting tape assembly inserted into the internal channel.

The invention in another form is directed to a lighting encasing unit for insertion into an extrusion having at least one T-shaped slot therein. The T-shaped slot having an opening along a length of the extrusion, with the lighting encasing unit being insertable into the T-shaped slot. The lighting encasing unit includes a shaped light conducting encasement having an internal channel along at least a substantial portion of a length of the shaped light conducting encasement and a light emitting tape assembly inserted into the internal channel.

Advantageously, the present invention provides a lighting system that may be used as a modular lighting system associated with a workstation, modular furniture or a living environment.

Additional features and advantages of the invention will be made apparent from the following detailed description of illustrative embodiments that proceeds with reference to the accompanying drawings.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
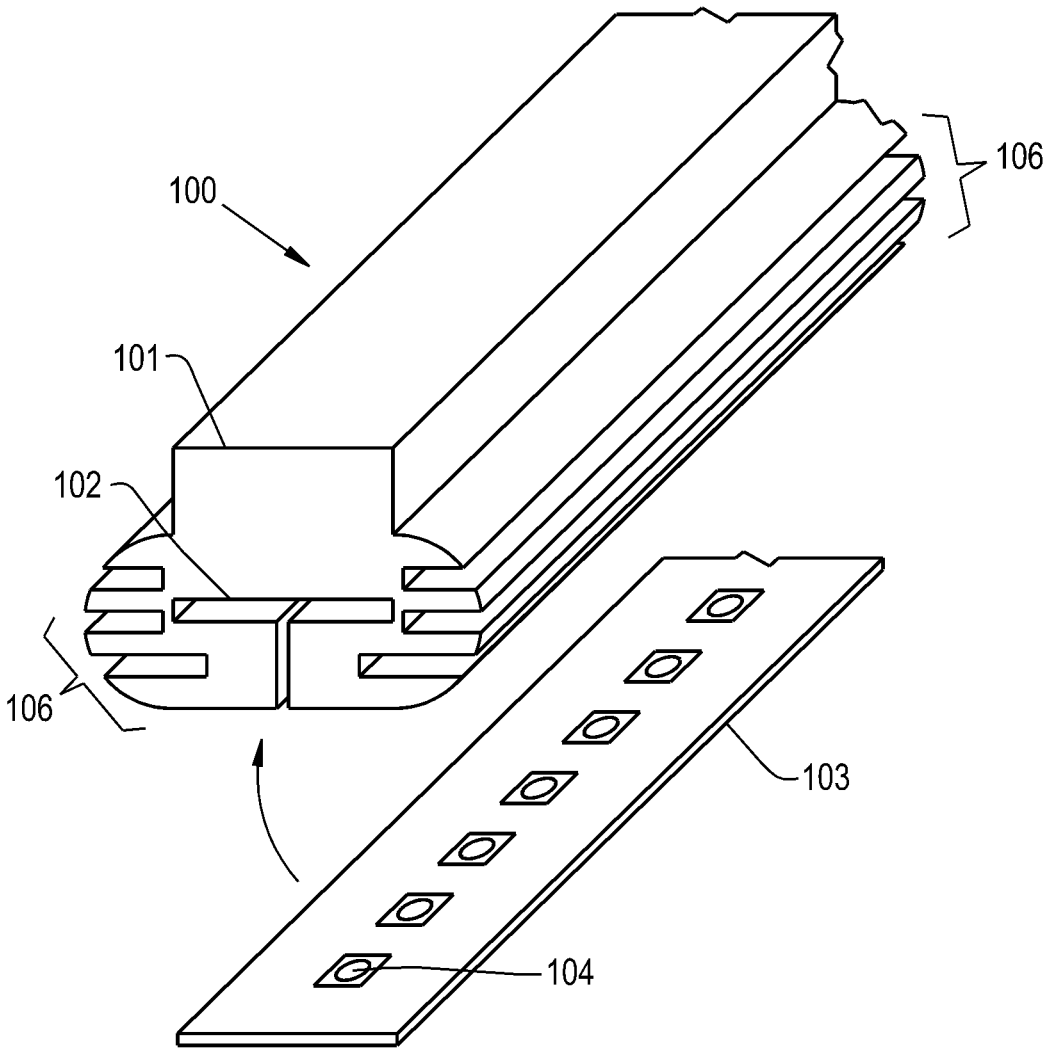
FIG. 1 is a perspective exploded view illustrating an embodiment of a lighting encasing unit of the present invention with an LED tape that is to be inserted therein.
Figure 2:
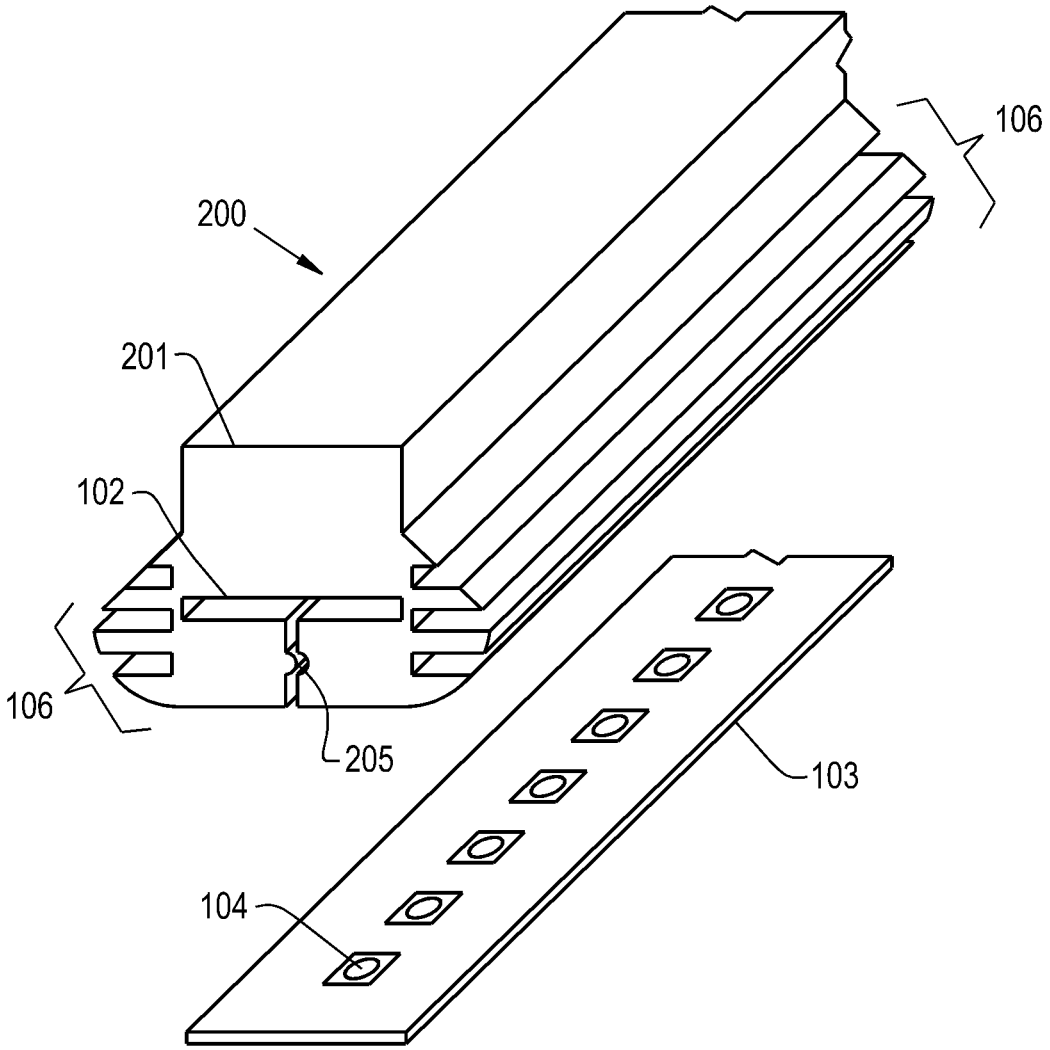
FIG. 2 is a perspective view illustrating another embodiment of the lighting encasing unit of the present invention, somewhat similar to the lighting encasing unit of FIG. 1.

Referring now to the drawings, and more particularly to FIGS. 1-5, there is illustrated an embodiment of a lighting system 500 that uses at least one of the embodiments of lighting encasing units 100, 200, 300, 400A, 400B, 400C, 400D of the present invention, represented as 501, which are inserted into a T-shaped slot 504 of an extrusion 511.

This invention pertains to a transparent or semi-translucent flexible holding carrier, in the form of lighting encasing units 100, 200, 300, 400A, 400B, 400C, 400D for capturing a section of tape light 103 and holding it securely in a T-Slot 504 extrusion profile. The invention is such that it can be easily cut to length and is flexible enough to deal with curves, corners and different tape widths plus heights.

The present invention relates to the lighting needs of residential, industrial, architectural and other environments. LED lighting products are widely used in the aforementioned industries. The present invention is a holding apparatus for LED tape light for insertion into T-slot extrusions 511. The present invention is not specific to use in a T-slot but is directed to the capture mechanism that is inserted into a T-slot 504 of an extrusion 511.

A flexible transparent or translucent material 101, 201, 301, 401A, 401B, 401C, 401D, etc., is extruded or molded to form an encasement 102 around a series of LEDs 104 of tape light 103. The assembly 501 is then pushed into a T-slot 504 of extrusion 511. Variations in the extrusion profile of lighting encasing units 100, 200, 300, 400A, 400B, 400C, 400D are available to suit different T-Slot extrusion profiles that are available, here represented as slot 504 of extrusion 511 and provide differing functionality or holding means. Height of the profile may also vary, as illustrated in assembly 400B of FIG. 4B to suit the application and T-Slot profile 511.

Lighting encasing units 100, 200, 400A, 400B, 400C, 400D each have an encasement 102, which can be forced together by the T-slot extrusion 511 and maybe sealed with a notch 205, 405 in the extruded flexible material. The notch 205, 405 may vary in shape, thickness and size depending upon the application as illustrated particularly in notch 405. Notch 205, 405 exist along a slot that extends from encasement 102 along the length of lighting encasing units 100, 200, 400A, 400B, 400C, 400D. This slot may be used by a mechanism that pulls light tape 103 into encasement 102. Additionally, this slot may be widened during the insertion of tape light 103 as it is inserted into encasement 102.

Another variation of the present invention shows an internal optic 406 that is formed during the extrusion or molding process in the form of a total internal reflection (TIR) optic, this allows for beam (light) shaping as the light exits the face of material 101, 201, 301 where the lead lines of these numerals touch. This optic 406 may take various forms to provide differing beam angles or spreads of light. The flexible material may also have a sideways protrusion 409 that sits on top of an extrusion 502.

The shape of the flexible extrusion 101, 201, 301, 401A, 401B, 401C, 401D may also include voids 408, 410, and 412 and the area between fingers 411 that allow for material reduction; and protrusions 303, 407 and 411, which can be associated with voids 408, 410, and 412, that together help the material flex during installation into the T-slot 504 of aluminum extrusion 511. Voids 408, 410, and 412; and fingers 411 may run the entire length of the extrusions 101, 201, 301, 401A, 401B, 401C, 401D.

Figure 3:
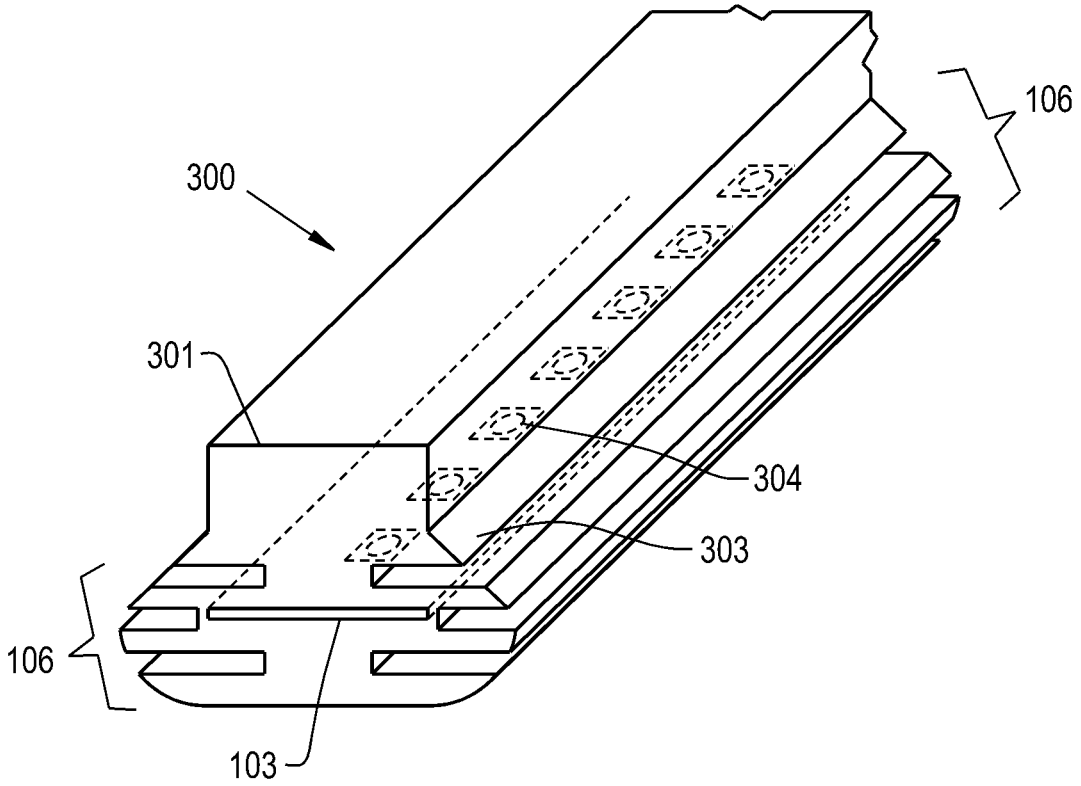
FIG. 3 is a perspective view of an assembled lighting encasing unit somewhat similar to those of FIGS. 1 and 2.

Yet another variation is shown in FIG. 3 where the LEDs 304 of light tape 103 is encased in material 301 into the extrusion and the flexible materials fully encases the LEDs 304.

Figure 4A:
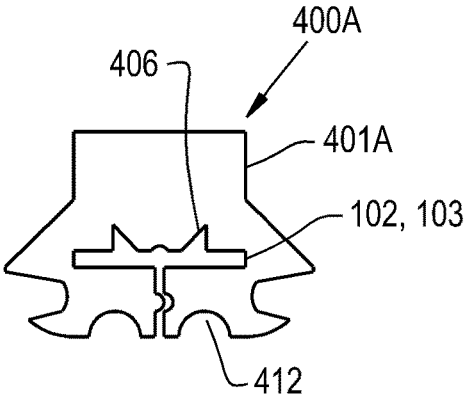
FIG. 4A is an end view of another embodiment of a lighting encasing unit of the present invention.
Figure 4B:
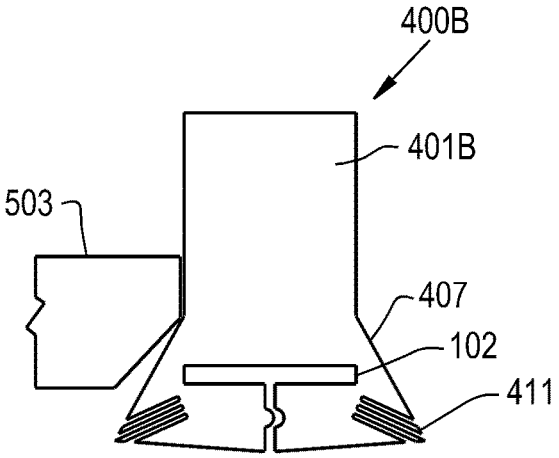
FIG. 4B is an end view of yet another embodiment of a lighting encasing unit of the present invention.

In FIG. 4B material 401B extends beyond extrusion portion 503, and although shown with a flat surface at the uppermost portion of the illustration, from which most of the light will emanate, it is also contemplated that this upper surface may be angled, curved, or shaped to alter the pathway of the light by optical methods. It is also contemplated that the surfaces can be uniform along the length of lighting encasing units 100, 200, 400A, 400B, 400C, 400D, or the surfaces can vary along the length to alter the pathway of the light in not just a 2-dimensional manner as viewed in cross section, such as that suggested by FIGS. 4A, 4B, 4C and 4D, but in a 3-dimensional manner, such that face 101 would have a varying surface along the length as well. It is also contemplated that portions of the surfaces of lighting encasing units 100, 200, 400A, 400B, 400C, 400D may have a coating that is reflective, colored or polarizing.

Lighting system 500 includes extrusion 511 having at least one T-shaped slot 504 therein. T-shaped slot 504 has an opening 506 along a length of extrusion 511, with a lighting encasing unit 100, 200, 300, 400A, 400B, 400C, 400D inserted into T-shaped slot 504. The lighting encasing unit 100, 200, 300, 400A, 400B, 400C, 400D includes a shaped light conducting encasement 101, 201, 301, 401A, 401B, 401C, 401D having an internal channel 102 along at least a substantial portion of a length of the shaped light conducting encasement 101, 201, 301, 401A, 401B, 401C, 401D; and a light emitting tape assembly 103 inserted into the internal channel 102. The light emitting tape assembly 103 is inserted into the internal channel 102 from an end of the shaped light conducting encasement 101, 201, 301, 401A, 401B, 401C, 401D.

Figure 4C:
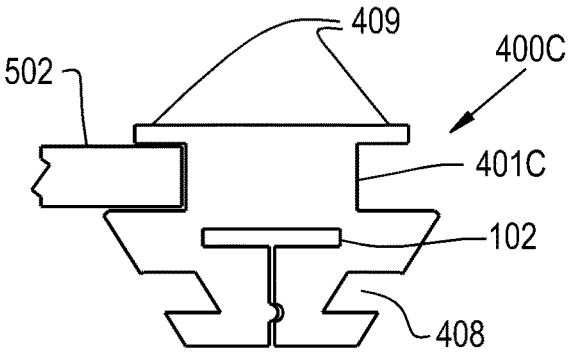
FIG. 4C is an end view of still yet another embodiment of a lighting encasing unit of the present invention.
Figure 4D:
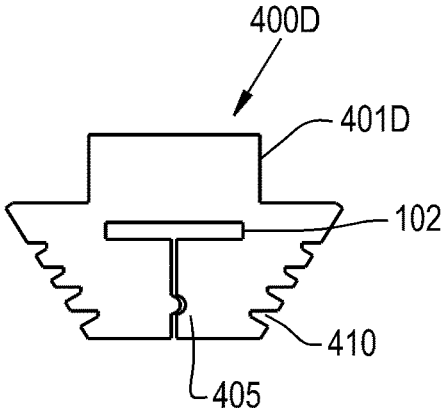
FIG. 4D is an end view of still yet another embodiment of a lighting encasing unit of the present invention.
Figure 5:
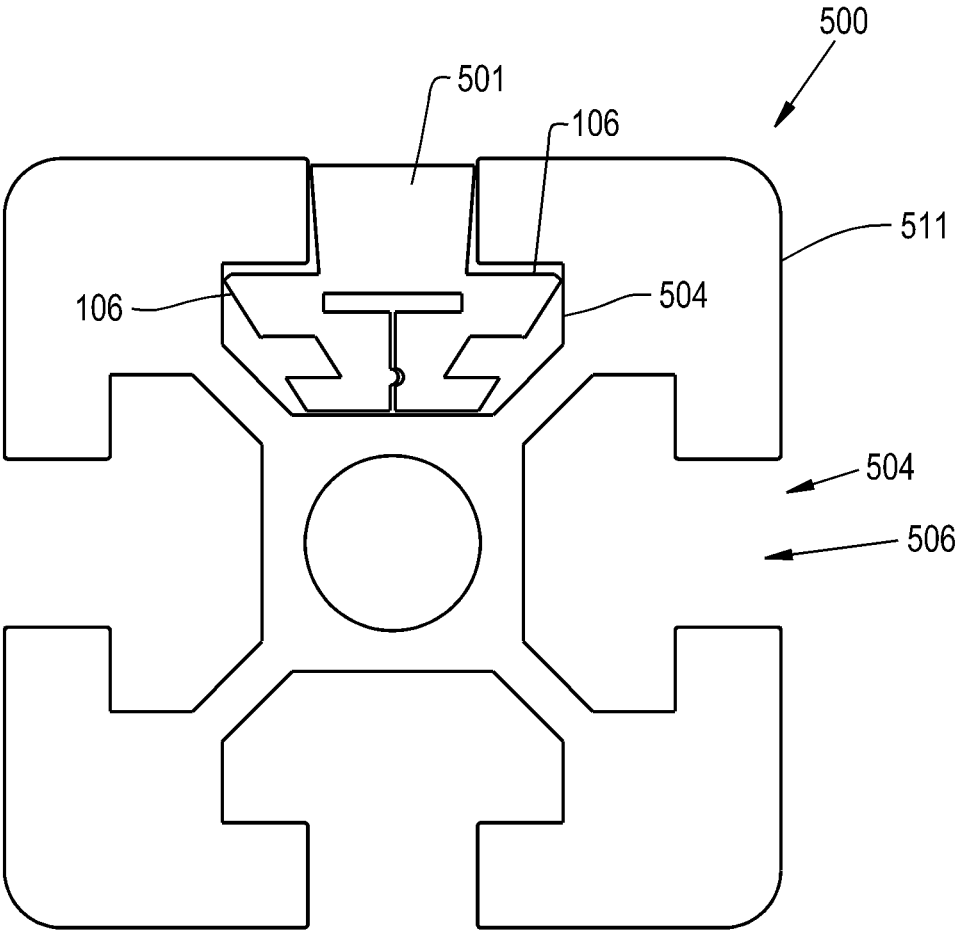
FIG. 5 is an end view that illustrates the insertion of a lighting system similar to any of FIGS. 1-3, which could be using any of the lighting encasing units of FIGS. 1-4D, into an extrusion.

The lighting encasing unit 100, 200, 300, 400A, 400B, 400C, 400D is inserted into the T-shaped slot 504 at an end of the extrusion 511. The shaped light conducting encasement 101, 201, 301, 401A, 401B, 401C, 401D has a face directed toward the opening 506 in the T-shaped slot 504. The face of the shaped light conducting encasement 101, 201, 301, 401A, 401B, 401C, 401D extends outwardly proximate to a surface 502 of extrusion 511 as illustrated in FIG. 4C. Alternatively, the face of the shaped light conducting encasement 101, 201, 301, 401A, 401B, 401C, 401D can extend outwardly beyond a surface 503 of the extrusion 511, as shown in FIG. 4B. The shaped light conducting encasement 401A includes a total internal reflection feature 406 positioned between the face and the light emitting tape assembly 103. The light emitting tape assembly 103 includes a plurality of light emitting diodes 104 positioned along the light emitting tape assembly 103. The shaped light conducting encasing unit 100, 200, 300, 400A, 400B, 400C, 400D includes a deformable section 106 in contact with an inner surface of the T-shaped slot 504. The deformable section 106 includes a plurality of linear protrusions 303, 411 extending along the shaped light conducting encasement 101, 201, 301, 401A, 401B, 401C, 401D.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lighting system, comprising:

an extrusion having at least one T-shaped slot therein, the T-shaped slot having an opening along a length of the extrusion; and a lighting encasing unit inserted into the T-shaped slot, the lighting encasing unit including:

a shaped light conducting encasement having an internal channel along at least a substantial portion of a length of the shaped light conducting encasement, the shaped light conducting encasement having a face directed toward the opening in the T-shaped slot; and a light emitting tape assembly inserted into the internal channel.

2. The lighting system of claim 1, wherein the light emitting tape assembly is inserted into the internal channel from an end of the shaped light conducting encasement.

3. The lighting system of claim 1, wherein the lighting encasing unit is inserted into the T-shaped slot at an end of the extrusion.

4. The lighting system of claim 1, wherein the face of the shaped light conducting encasement extends outwardly proximate to a surface of the extrusion.

5. The lighting system of claim 1, wherein the face of the shaped light conducting encasement extends outwardly beyond a surface of the extrusion.

6. The lighting system of claim 1, wherein the shaped light conducting encasement includes a total internal reflection feature positioned between the face and the light emitting tape assembly.

7. The lighting system of claim 1, wherein the light emitting tape assembly includes a plurality of light emitting diodes positioned along the light emitting tape assembly.

8. The lighting system of claim 1, wherein the shaped light conducting encasement includes a deformable section in contact with an inner surface of the T-shaped slot.

9. The lighting system of claim 8, wherein the deformable section includes a plurality of linear protrusions extending along the shaped light conducting encasement.

10. A lighting encasing unit for insertion into a T-shaped slot of an extrusion, the T-shaped slot having an opening, the lighting encasing unit comprising:

a shaped light conducting encasement having an internal channel along at least a substantial portion of a length of the shaped light conducting encasement, the shaped light conducting encasement having a face directable toward the opening in the T-shaped slot; and a light emitting tape assembly inserted into the internal channel.

11. The lighting encasing unit of claim 10, wherein the light emitting tape assembly is inserted into the internal channel from an end of the shaped light conducting encasement.

12. The lighting encasing unit of claim 10, wherein the lighting encasing unit is insertable into the T-shaped slot at an end of the extrusion.

13. The lighting encasing unit of claim 10, wherein the face of the shaped light conducting encasement is configured to extend outwardly proximate to a surface of the extrusion.

14. The lighting encasing unit of claim 10, wherein the face of the shaped light conducting encasement is configured to extend outwardly beyond a surface of the extrusion.

15. The lighting encasing unit of claim 10, wherein the shaped light conducting encasement includes a total internal reflection feature positioned between the face and the light emitting tape assembly.

16. The lighting encasing unit of claim 10, wherein the light emitting tape assembly includes a plurality of light emitting diodes positioned along the light emitting tape assembly.

17. A lighting encasing unit for insertion into a T-shaped slot of an extrusion, the T-shaped slot having an opening, the lighting encasing unit comprising:

a shaped light conducting encasement having an internal channel along at least a substantial portion of a length of the shaped light conducting encasement; and a light emitting tape assembly inserted into the internal channel, the shaped light conducting encasement includes a deformable section configured to be in contact with an inner surface of the T-shaped slot.

18. The lighting encasing unit of claim 17, wherein the deformable section includes a plurality of linear protrusions extending along the shaped light conducting encasement.

* * * * *